United States Patent [19]

Lipschutz

[11] 4,018,069

[45] Apr. 19, 1977

[54] KEY-ACTUATED BARREL-TYPE LOCKS

[75] Inventor: Paul Lipschutz, Croissy, France

[73] Assignee: Neiman, S.A., Courbevoie, France

[22] Filed: Mar. 25, 1976

[21] Appl. No.: 670,313

[30] Foreign Application Priority Data

May 5, 1975 France ..... 75.13894

[52] U.S. Cl. ..... 70/395; 70/423; 70/429

[51] Int. Cl.[2] ..... E05B 19/00

[58] Field of Search ..... 70/394, 364 A, 429, 70/423, 252, 455, 395, 397, 398, 408

[56] References Cited

UNITED STATES PATENTS 975,122 11/1910 Crabtree ..... 70/429

*Primary Examiner*—Robert L. Wolfe

*Attorney, Agent, or Firm*—Nolte and Nolte

[57] ABSTRACT

A lock having a key-actuated rotary barrel. Said key comprises a holding head axially slidably mounted on a body which head has a radial abutment. The lock has a key entrance surface spaced from the key entrance of the barrel and said surface has a key inserting opening having at least one radial abutment cooperable with said radial abutment of the key head for an axial position of the key head with respect to the key body.

6 Claims, 3 Drawing Figures

Fig 2
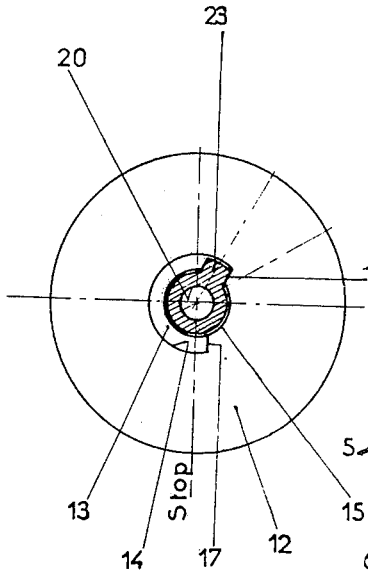
Fig 1
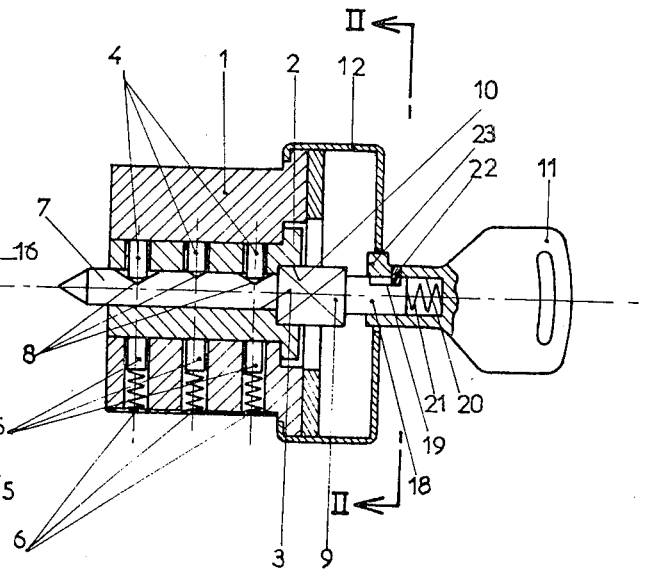
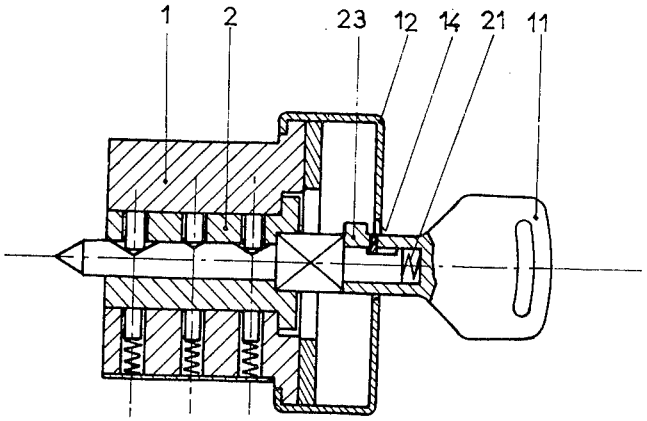
Fig 3

KEY-ACTUATED BARREL-TYPE LOCKS

The present invention relates to improvements in key-actuated barrel-type locks which are very common in vehicles, buildings, etc.

It is often desirable to ensure that the passage of the barrel, and therefore of the key driving it, to certain angular positions cannot occur accidentally. It is thus desirable, and sometimes required by law, to ensure that such a passage requires a deliberate and conscious action on the part of the user.

In order to avoid the use of a special means for precluding rotation of the barrel which is manually withdrawable, it has been proposed to construct locks in such a manner that the user is obliged, in order to pass to a critical position, to push or pull on the key in the axial direction while driving the barrel, which is axially slidable. Such a construction considerably complicates the lock and greatly increases its cost. Moreover, locks of this type have a much greater overall length than conventional locks having a non-sliding barrel.

An object of the present is to provide a novel lock having a non-sliding barrel which gives the same aforementioned result in a simple and cheap manner, with substantially no increase in the overall size.

According to the invention, there is provided a lock having a key-actuated rotatable barrel, wherein said key is constituted by a holding head which is mounted to be axially slidable on a body, said head comprising a radial abutment, the lock having a key entrance surface spaced from the key entrance of the barrel, said surface defining a key insertion opening having at least one radial abutment cooperable with said radial abutment of the key head for an axial position of the key head with respect to the key body.

With the lock according to the invention, the cooperation of the abutment of the recess and that of the key head precludes a continued rotation of the key and the operator must then act axially on the key head so that the abutments no longer cooperate.

In a preferred embodiment of the invention, elastically yieldable means are provided for returning the key head to said axial position.

In one form of the invention, said key entrance surface is constituted by a cover plate attached to the lock body.

An understanding of the invention will be had from the ensuing description with reference to the accompanying drawing in which:

FIG. 1 is an axial section view of a lock according to one embodiment of the invention;

FIG. 2 is a sectional view taken on line II–II of FIG. 1, and

FIG. 3 is similar to FIG. 1 in respect of a different position of the key.

For the purpose of illustrating the invention, there has been shown in the drawing an anti-theft lock for a vehicle having a Diesel engine, merely by way of example to which the invention is not intended to be limited. In an anti-theft device for a Diesel engine, which must also actuate the starter, it is desirable to have a "pre-heating" position, and the user must not pass from this "pre-heating" position to the "starter" position before a given minimal period of time has elapsed, which is usually indicated by an indicator light.

In the course of the rotation of the key from the "stop" position, the movement must be stopped at the "pre-heating" position and the user must not be able to leave this position without a special and deliberate action.

In the embodiment illustrated and described, the lock is of the known key type having a cylindrical body. However, it must be understood that the invention is applicable to all types of barrel-type locks, for example employing flat keys notched on at least one edge or having recesses on at least one planar face.

The lock comprises a body or stator 1 in which there is journalled a cylindrical rotor or barrel 2 provided with a cylindrical and axial key passage 3. The rotor has a row of radial bores each provided with a piston 4 and the stator has a corresponding row of radial bores provided with pistons 5 biased by springs 6.

The key for driving the rotor 2 has a cylindrical body 7 provided with notches 8 adapted to cooperate with the ends of the pistons 4 opposed to the rotor. The body 7 of the key is extended by a driver which has a non-circular cross-sectional shape and cooperates with a cavity 10 of corresponding shape formed in the rotor 2 at the entrance of the passage 3, with this cooperation ensuring a positive driving of the rotor 2. The key terminates in a holding head 11.

A cover-plate 12 is secured to the stator 1 and defines a space between the entrance of the passage and the inner face of the cover-plate. The cover-plate 12 has a key inserting opening 13 (FIG. 2) which has a first part 14 in the shape of an arc of a circle and a second part is in the shape of an arc of a circle which is concentric with the first part but of smaller radius. The parts 14 and 15 are interconnected by two radial segments 16 and 17.

The driver 9 of the key is extended at the end of the key opposed to the body 7 by a stem 18 provided with a longitudinal notch 19. The key head 11 has an axial blind bore 20 in which the stem 18 is slidable, and a compression coil spring 21 is interposed between the end of the bore 20 and the end of the stem 18. A pin 22, integral with the key head 11, cooperates with the notch 19 so as to maintain the head 11 connected to the rest of the key and to limit movements of the head 11 with respect to the rest of the key. The head 11 also has a radial projection 23.

The device just described operates in an extremely simple manner. The user inserts the key in the passage 3 and causes the projection 23 to abut against the segment 17 in which position he can fully insert the key since the driver 9 is in front of the cavity 10. In this position (not shown), which is the "stop" position in which the pistons 4 are in facing relation to the pistons 5, the notches 8 of the key allow the springs 6 to bias the pistons 4 and 5 toward the axis of the lock and the pistons 5 and 4 come in contact with each other within the cylindrical outer surface of the rotor 2 so that the latter is free to rotate and may be rotated by acting on the key. Owing to the effect of the segment 17, this rotation can only occur in the clockwise direction (as viewed in FIG. 2).

When the projection 23 abuts against the segment 16 further rotation of the key is precluded. The lock is in the "pre-heating" position. To continue rotation of the key in the clockwise direction, the user must push the head 11 axially in against the action of the spring 21 (FIG. 3). The projection 23 then enters the space between the cover-plate 12 and the lock and therefore disengages from the segment 16 so that rotation of the key can be continued until an abutment (not shown), corresponding to the "starter" position, is reached. When the user releases the key, the latter returns, under the action of elastically yieldable means (not shown), to the "on" position which is in the angular zone covered by the arc of the circle 14 where the spring 21 returns the key head 11 to its position in which it is moved away from the body 7 to the maximum extent.

The system according to the invention also constitutes, in the described embodiment, safety means precluding any actuation of the starter while the engine is running.

The key just described may of course be provided with conventional devices precluding extraction of the key in positions thereof other than the "stop" position. Furthermore, in order to ensure that a depression of the head 11 when the projection 23 abuts against the segment 17 does not allow a rotation of the key in the counter-clockwise direction beyond the segment 17, the latter may be bordered by a wall (not shown) which is folded to extend axially toward the barrel in the space between the barrel 2 and the cover-plate 12. This wall constitutes an abutment for the projection 23 even when the head 11 is pushed in. For reasons of simplification, the locking and/or electrical control means, actuated by the barrel in the course of its rotation, have not been illustrated or described.

In addition to the advantages already mentioned for the whole of the lock, the lock key according to the invention provides the important improvement of increased safety in the case of a blow on the key, since, in this case, the key is pushed in under the effect of the impact of the body and this impact therefore tends to be absorbed.

What is claimed is:

1. In combination, a lock having a body and a rotary barrel and a key comprising a manipulating head and an operating stem for insertion into, and cooperation with, said barrel, means mounting said head to be axially shiftable relative to said stem between a first and a second position, abutment means on said head and means on said lock defining two angularly spaced abutment surfaces cooperating with said abutment means, said abutment surfaces being axially disposed to be engageable by said abutment means in said first position to permit rotation of said head in said first position between said surfaces and to preclude rotation beyond said surfaces and, in said second position, to be disengaged from said surfaces to permit rotation of said head beyond at least one of said surfaces.

2. A combination as claimed in claim 1 wherein said second position is closer to a distal end of said stem than said first position.

3. A combination as claimed in claim 1, wherein said means on said lock defining said surfaces is constituted by a cover plate attached to the lock body.

4. A combination as claimed in claim 1 1 wherein means are provided biasing said head part in one direction longitudinally of said stem between said first and second positions.

5. A combination as claimed in claim 4 wherein said biasing means bias said head part in a direction away from a leading end of said stem.

6. A combination as claimed in claim 1 wherein said head part and said stem are telescopically mounted one upon another, said stem having a male configuration received within a correspondingly shaped female configuration of said head part.

* * * * *